US010396454B2

(12) United States Patent
Langer

(10) Patent No.: US 10,396,454 B2
(45) Date of Patent: Aug. 27, 2019

(54) SIMPLIFIED ANTENNA PEAKING APPARATUS

(71) Applicant: Dish Network L.L.C., Englewood, CO (US)

(72) Inventor: Paul Langer, Englewood, CO (US)

(73) Assignee: DISH Network L.L.C., Englewood, CO (US)

( * ) Notice: Subject to any disclaimer, the term of this patent is extended or adjusted under 35 U.S.C. 154(b) by 49 days.

(21) Appl. No.: 15/855,821

(22) Filed: Dec. 27, 2017

(65) Prior Publication Data

US 2019/0198991 A1 Jun. 27, 2019

(51) Int. Cl.

| | |
|---|---|
| ***H01Q 3/08*** | (2006.01) |
| ***H01Q 15/14*** | (2006.01) |
| ***H01Q 1/12*** | (2006.01) |

(52) U.S. Cl.

CPC ..... *H01Q 3/08* (2013.01); *H01Q 1/125* (2013.01); *H01Q 15/14* (2013.01)

(58) Field of Classification Search

CPC ..... H01Q 3/08; H01Q 1/12; H01Q 15/14

USPC ..... 343/760

See application file for complete search history.

(56) References Cited

U.S. PATENT DOCUMENTS

2002/0084948 A1* 7/2002 Watson ..... H01Q 1/125 343/882

2016/0336640 A1* 11/2016 Bailey ..... H01Q 1/125

* cited by examiner

*Primary Examiner* — Andrea Lindgren Baltzell

(74) *Attorney, Agent, or Firm* — Seed IP Law Group LLP

(57) ABSTRACT

Embodiments are directed towards an antenna mount that is configured with a self-plumbing mast for simplified peaking. The mounting system includes an elevation alignment joint that includes a first member and a second member, which are configured to rotate about a central axis and can be locked into a fixed rotation. A plumb is connected to the first member and an antenna mounting support is connected to the second member such that the antenna position is maintained at an elevation identified on the first member when in the fixed rotation. The mounting system also includes a base assembly that is configured to hold the elevation alignment joint such that the plumb weight self-orients in a vertical, plumb position with the antenna at the desired elevation. The base assembly also includes a compass for aligning the azimuth of the antenna.

20 Claims, 14 Drawing Sheets

SIMPLIFIED ANTENNA PEAKING APPARATUS

TECHNICAL FIELD

The present disclosure relates generally to antenna assemblies, such as a satellite dish.

BACKGROUND

Description of the Related Art

Antennas, such as satellite dishes, for direct-broadcast satellite (DBS) or broadband antenna systems generally utilize brackets that are mounted to a wall or roof of a user's house. These mounting systems typically require the installer to drill into the user's house and install an antenna mount with such precision as to ensure a plumb mast. Once mounted, the installer peaks the antenna by setting the azimuth and elevation to find the satellite or satellites depending on the antenna utilized. Due to the precision demands of mounting and peaking the antenna, most antennas are installed by a trained technician and not by the user. However, sending a trained technician to install an antenna can be quite costly to the satellite broadcast company, especially with respect to customers that are paying for a very minimal, low cost subscription. It is with respect to these and other considerations that the embodiments described herein have been made.

BRIEF SUMMARY

Briefly described, embodiments are directed toward systems, apparatuses, and assemblies for providing an antenna mount that is configured with a self-plumbing mast for simplified peaking. The mounting system includes an elevation alignment joint that includes a first member and a second member, which are configured to rotate about a central axis and can be locked into a fixed rotation. A plumb is connected to the first member and an antenna mounting support is connected to the second member such that the antenna position is maintained at an elevation identified on the first member when in the fixed rotation. The mounting system also includes a base assembly that is configured to hold the elevation alignment joint such that the plumb weight self-orients in a vertical, plumb position with the antenna at the desired elevation. The base assembly also includes a compass for aligning the azimuth of the antenna.

The antenna mounting system described herein provides a low cost solution for a user to easily peak the antenna without mounting to a fixed structure. And since the system does not require mounting to a fixed structure, the antenna mounting system is movable, which provides the additional benefit of allowing the user to set up the antenna in remote locations other than at their home.

BRIEF DESCRIPTION OF THE SEVERAL VIEWS OF THE DRAWINGS

Non-limiting and non-exhaustive embodiments are described with reference to the following drawings. In the drawings, like reference numerals refer to like parts throughout the various figures unless otherwise specified.

For a better understanding of the present invention, reference will be made to the following Detailed Description, which is to be read in association with the accompanying drawings.

DETAILED DESCRIPTION

The following description, along with the accompanying drawings, sets forth certain specific details in order to provide a thorough understanding of various disclosed embodiments. However, one skilled in the relevant art will recognize that the disclosed embodiments may be practiced in various combinations, without one or more of these specific details, or with other methods, components, devices, materials, etc. In other instances, well-known structures or components that are associated with antenna mounts and assemblies have not been shown or described in order to avoid unnecessarily obscuring descriptions of the embodiments.

Throughout the specification, claims, and drawings, the following terms take the meaning explicitly associated herein, unless the context clearly dictates otherwise. The term "herein" refers to the specification, claims, and drawings associated with the current application. The phrases "in one embodiment," "in another embodiment," "in various embodiments," "in some embodiments," "in other embodiments," and other variations thereof refer to one or more features, structures, functions, limitations, or characteristics of the present disclosure, and are not limited to the same or different embodiments unless the context clearly dictates otherwise. As used herein, the term "or" is an inclusive "or" operator, and is equivalent to the phrases "A or B, or both" or "A or B or C, or any combination thereof," and lists with additional elements are similarly treated. The term "based on" is not exclusive and allows for being based on additional features, functions, aspects, or limitations not described, unless the context clearly dictates otherwise. In addition, throughout the specification, the meaning of "a," "an," and "the" include singular and plural references.

Figure 1A:
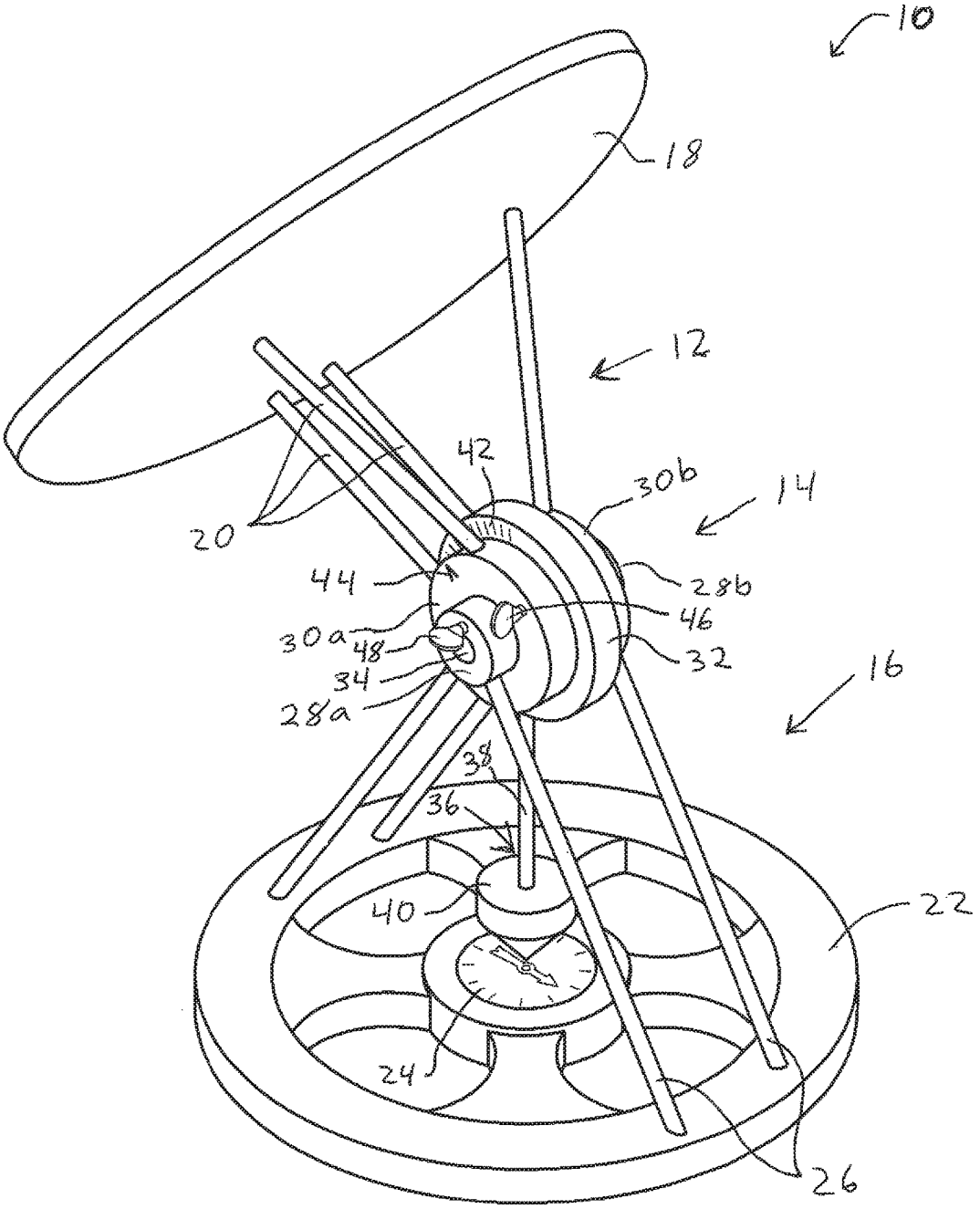
FIGS. 1A-1C are simplified views of an antenna orientation assembly according to one embodiment as described herein.
Figure 1B:
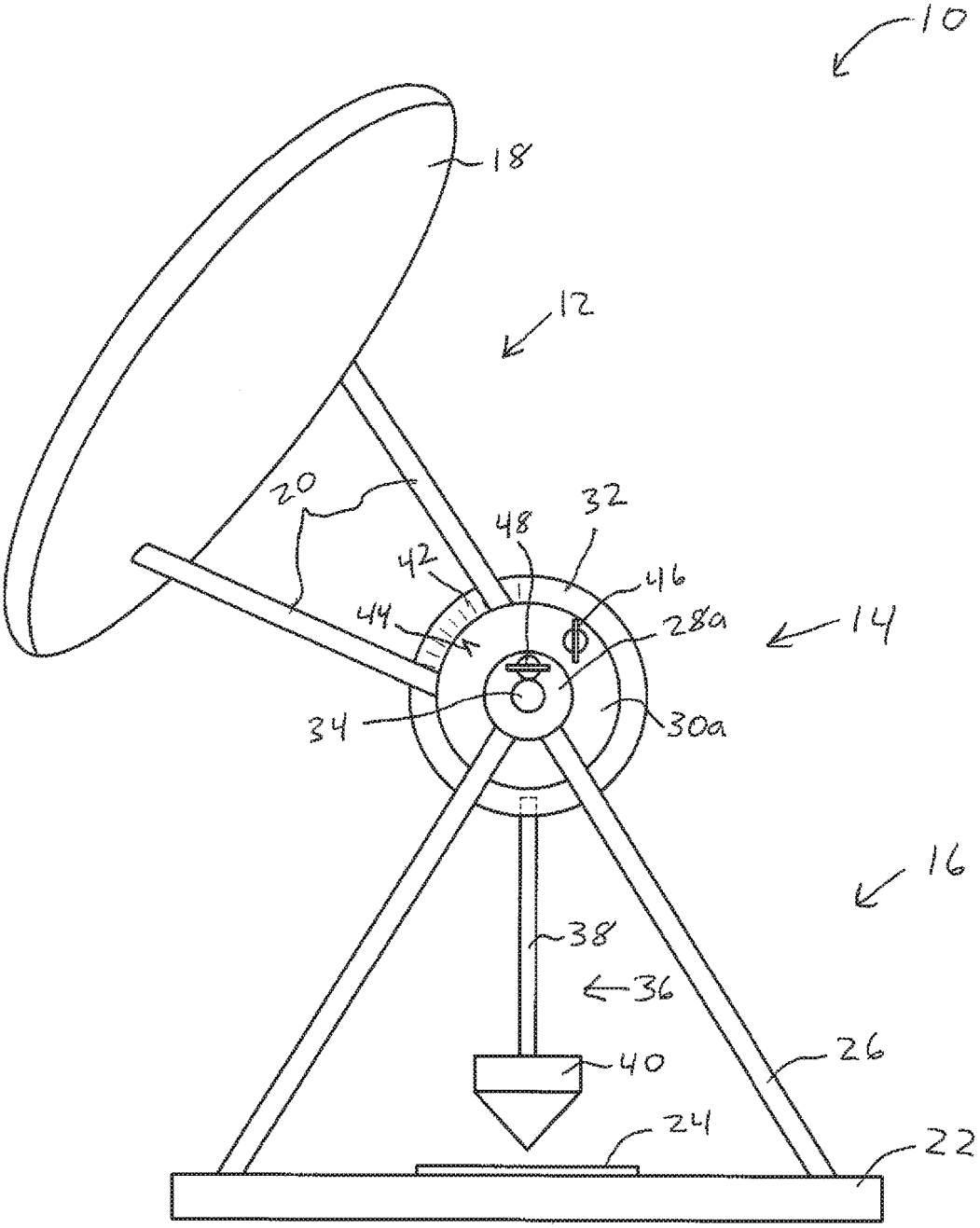
Figure 1C:
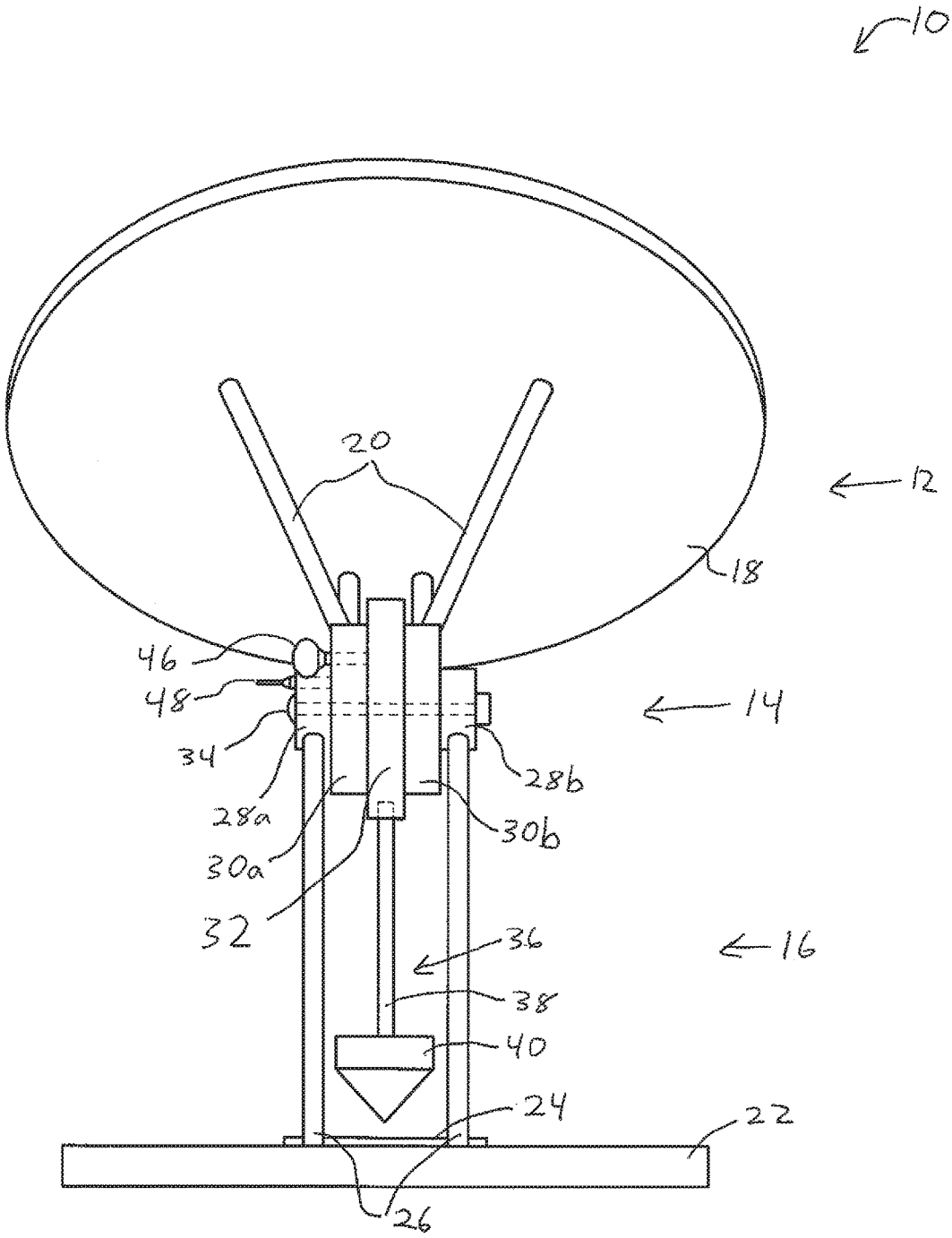

FIGS. 1A-1C are simplified views of an antenna orientation assembly according to one embodiment as described herein. FIG. 1A is a simplified perspective view of an antenna orientation assembly 10. FIG. 1B is a simplified side view of the antenna orientation assembly 10. And FIG. 1C is a simplified back view of the antenna orientation assembly 10.

The antenna orientation assembly 10 includes an antenna assembly 12, an elevation alignment joint 14, and a base assembly 16.

The antenna assembly 12 includes an antenna 18 and a plurality of antenna support members 20. The antenna 18 is any type of antenna that is configured to receive orbital signals from a satellite, such as a satellite antenna. The antenna support members 20 are configured to connect the antenna 18 to the rest of the antenna orientation assembly 10, where a first end of the antenna support members 20 is configured to connect to the antenna and a second end is configured to connect to the elevation alignment joint 14.

The base assembly 16 is a stand that includes a base 22, a compass 24, and base support members 26. The compass 24 and the base 22 are configured to position the antenna 18 at a desired azimuth to peak the received signal from a satellite, which is discussed in more detail below in conjunction with FIGS. 2A-2C. As illustrated in FIG. 1A, the compass 24 is positioned near a central location on the base 22. Although, embodiments are not so limited and the compass 24 may be positioned at other locations on the base 22 or the base assembly 16.

The base support members 26 of the base assembly 16 are configured to connect the elevation alignment joint 14 to the base 22, where a first end of the base support members 26 is configured to connect to the base 22 and a second end is configured to connect to the elevation alignment joint 14. In various embodiments, the base support members 26 are configured to position the elevation alignment joint 14 substantially centered and over the compass 24, such as is illustrated.

The base 22 of the base assembly 16 provides a footing for the antenna orientation assembly 10 to rest on the ground or other surface. Although the base 22 is illustrated as being disk-shaped, embodiments are not so limited. In other embodiments, the base 22 may be square-shaped or some other shape. In some embodiments, the base may also include one or more legs (not illustrated) that can contact the ground to provide additional support for the antenna orientation assembly 10. In at least one such embodiment, the legs may be telescoping or otherwise adjustable to provide another degree in which to adjust the positioning of the antenna 18 to peak the signal from the satellite.

The elevation alignment joint 14 includes one or more base connection members **28*a*-28*b*, one or more antenna connection members 30*a*-30*b*, and a plumb connection member 32 that are aligned on a central axial bore on axle 34. The elevation alignment joint 14 is configured to attach the antenna assembly 12 to the base assembly 16 while allowing for adjustment of the elevation of the antenna 18. In various embodiments the elevation alignment joint 14** may be considered to be a hinge that allows for adjustment in the antenna elevation direction.

The base connection members **28*a*-28*b* of the elevation alignment joint 14 are configured to connect the elevation alignment joint 14 to the base support members 26 of the base assembly 16. Although FIG. 1 illustrates two base connection members 28*a*-28*b*, embodiments are not so limited. In other embodiments, only a single base connection member 28*a* may be utilized. In at least one such embodiment, additional base support members 26 or other configurations of base support members 26 may be utilized to distribute the weight of the elevation alignment joint 14 and the antenna assembly 12 onto the base assembly 16**.

The antenna connection members **30*a*-30*b* of the elevation alignment joint 14 are configured to connect the antenna support members 20 of the antenna assembly 12 to the elevation alignment joint 14. Although FIG. 1 illustrates two antenna connection members 30*a*-30*b*, embodiments are not so limited. In other embodiments, only a single antenna connection member 30*a* may be utilized. In at least one such embodiment, additional antenna support members 20 or other configurations of antenna support members 20 may be utilized to distribute the weight of the antenna 18 onto the elevation alignment joint 14**.

The plumb connection member 32 of the elevation alignment joint 14 is configured to be connected to a plumb 36. The plumb 36, when connected to the plumb connection member 32, is configured to allow gravity to position the plumb 36 in a vertical or plumb position. The plumb 36 includes a plumb mast 38 and a plumb weight 40. One end of the plumb mast 38 connects to the plumb connection member 32 and the other end of the plumb mast 38 connects to the plumb weight 40. The weight of the plumb weight 40 is selected such that the total weight of the plumb 36 is more than the weight of the antenna assembly 12 plus any additional weight from cables or other components attached to the antenna assembly 12, which allows the plumb 36 to self-align in a vertical position when fixed to the antenna assembly 12.

The antenna connection members **30*a*-30*b* and the plumb connection member 32 are configured to be flexibly connected so that they freely rotate along the axle 34 relative to the base connection members 28*a*-28*b*. In this way, the angle or elevation between the antenna 18 and the plumb mast 38 can be adjusted. At least one of the antenna connection members 30*a*-30*b*, e.g., antenna connection member 30*a*, includes an antenna elevation marker 44. The antenna elevation marker 44 indicates the elevation angle of the antenna 18. Conversely, the plumb connection member 32 includes a plurality of elevation markers 42. The elevation markers 42 indicate different elevations relative to the plumb mast 38**.

Since the elevation alignment joint 14 and the plumb connection member 32 are configured to allow the plumb 36 to self-align the plumb mast 38 in a vertical position, the elevation markers 42 indicate the possible elevation positions of the antenna 18. Moreover, since the elevation alignment joint 14 and the antenna connection members **30*a*-30*b* are configured so that the antenna connection members 30*a*-30*b* freely rotate about the axle 34, the elevation of the antenna 18 can be adjusted with respect to the plumb 36 by aligning the antenna elevation marker 44 on the antenna connection member 30*a* with the desired elevation on the elevation markers 42 on the plumb connection member 32. In various embodiments, the user is provided the desired elevation based on the geographical location of the antenna orientation assembly 10 and the position of the satellite that is transmitting the orbital signals to the antenna 18**.

It should recognized that in some situations the plumb may not be fully vertical, in which case the positioning of the elevation markers 42 during manufacture may be adjusted to account for any angle created when the plumb hangs free with the weight of the antenna assembly. In other embodiments, the desired elevation provided to the user may account for the plumb angle variation.

Once the antenna assembly 12 is positioned such that the antenna elevation marker 44 on the antenna connection member **30*a* of the elevation alignment joint 14 is aligned with the desired elevation on the elevation markers 42 on the plumb connection member 32, a first locking mechanism 46 is engaged. Engagement of the first locking mechanism 46 fixes the position of the antenna connection members 30*a*-30*b* with the plumb connection member 32. In this way, the elevation angle of the antenna 18 is secured relative to the plumb 36**.

In the illustrated example, the first locking mechanism 46 is a set screw through the antenna connection member **30*a*, and when engaged exerts pressure on the plumb connection member 32 to secure the positions of the antenna connection members 30*a*-30*b* and the plumb connection member 32** relative to one another. It should be recognized that other types of locking mechanisms between the antenna connection members 30*a*-30*b* and the plumb connection member 32 may also be employed.

With the first locking mechanism 46 engaged, and the second locking mechanism 48 disengaged, the plumb 36 is allowed to self-align in a vertical position, which aligns the antenna 18 into the desired elevation. Once the plumb 36 is self-aligned in a vertical position, the second locking mechanism 48 is engaged to fix the position of the antenna connection members 30*a*-30*b* and the plumb connection member 32 relative to the base connection members 28*a*-28*b*.

In the illustrated example, the second locking mechanism 48 is a set screw through the base connection member 28*a*, and when engaged exerts pressure on the antenna connection member 30*a* to secure the position of the locked antenna connection member 20 and plumb connection member 32 relative to the base connection members 28*a*-28*b*. It should be recognized that other types of locking mechanisms between the base connection members 28*a*-28*b* and the locked antenna connection members 30*a*-22*b* and the plumb connection member 32 may also be employed.

Figure 2A:
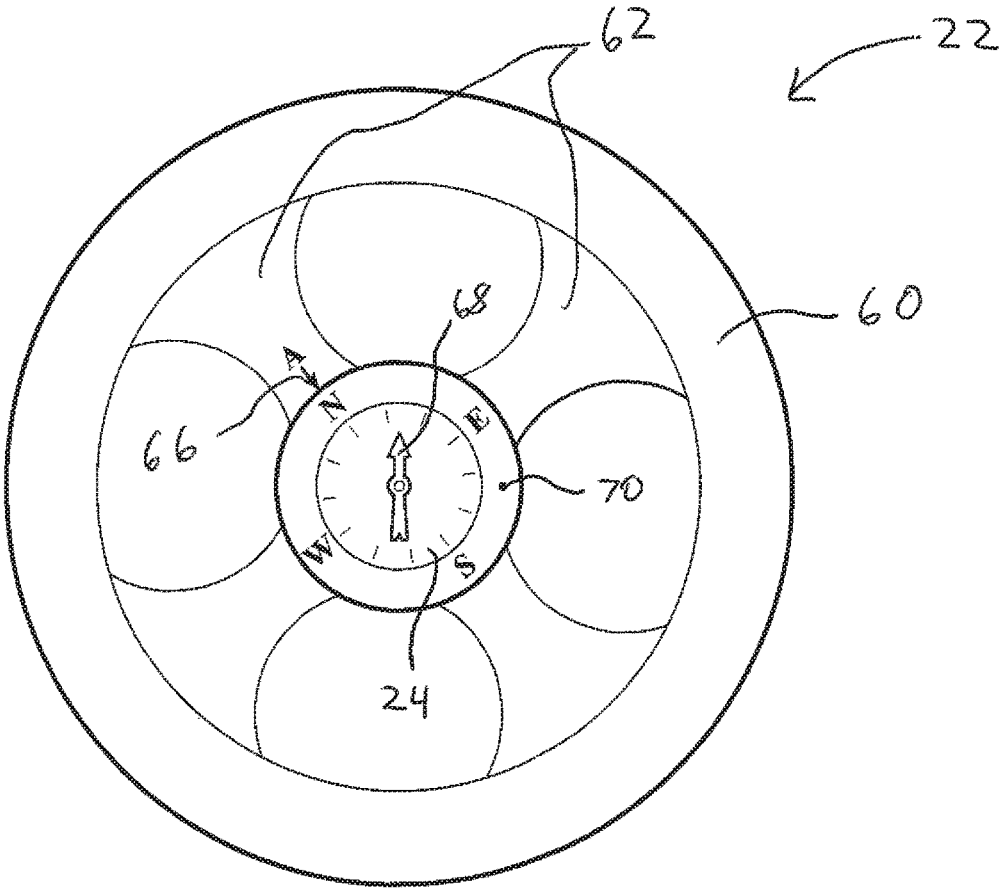
FIGS. 2A-2C are simplified views of a base and compass of an antenna orientation assembly according to one embodiment as described herein.
Figure 2B:
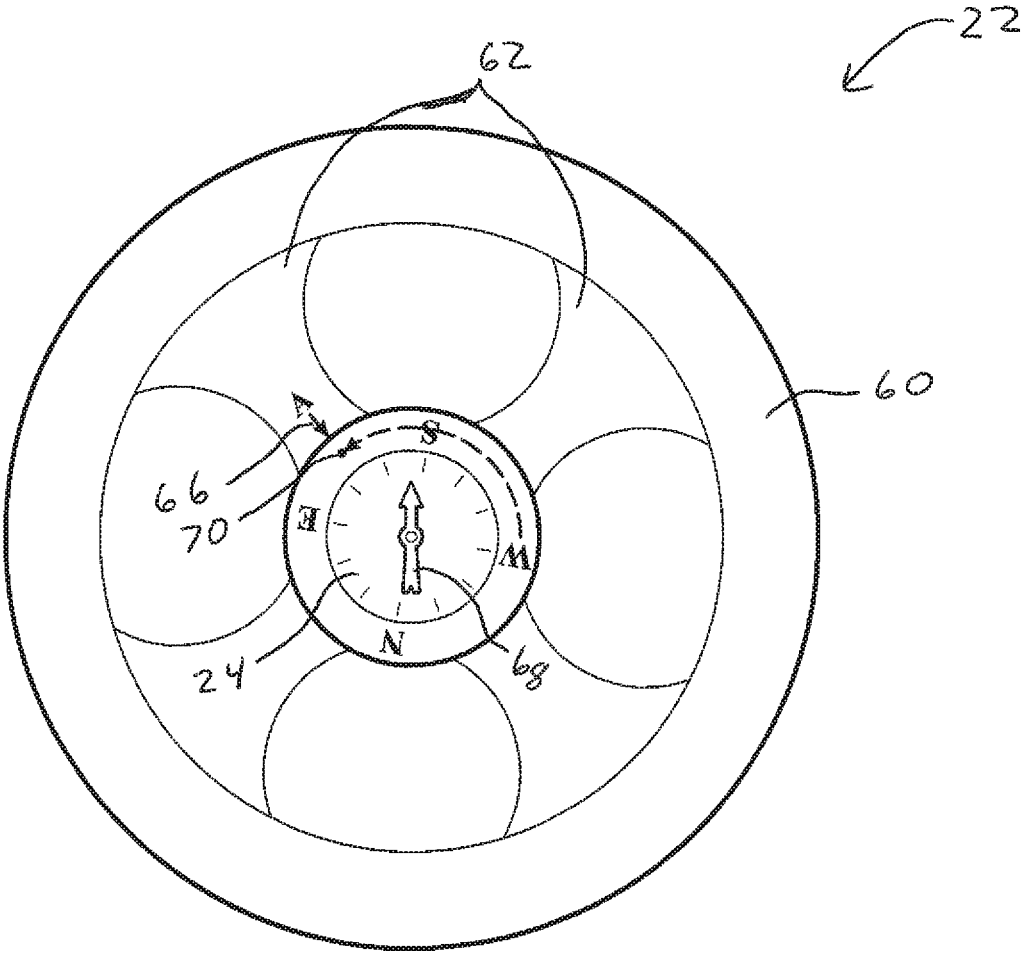
Figure 2C:
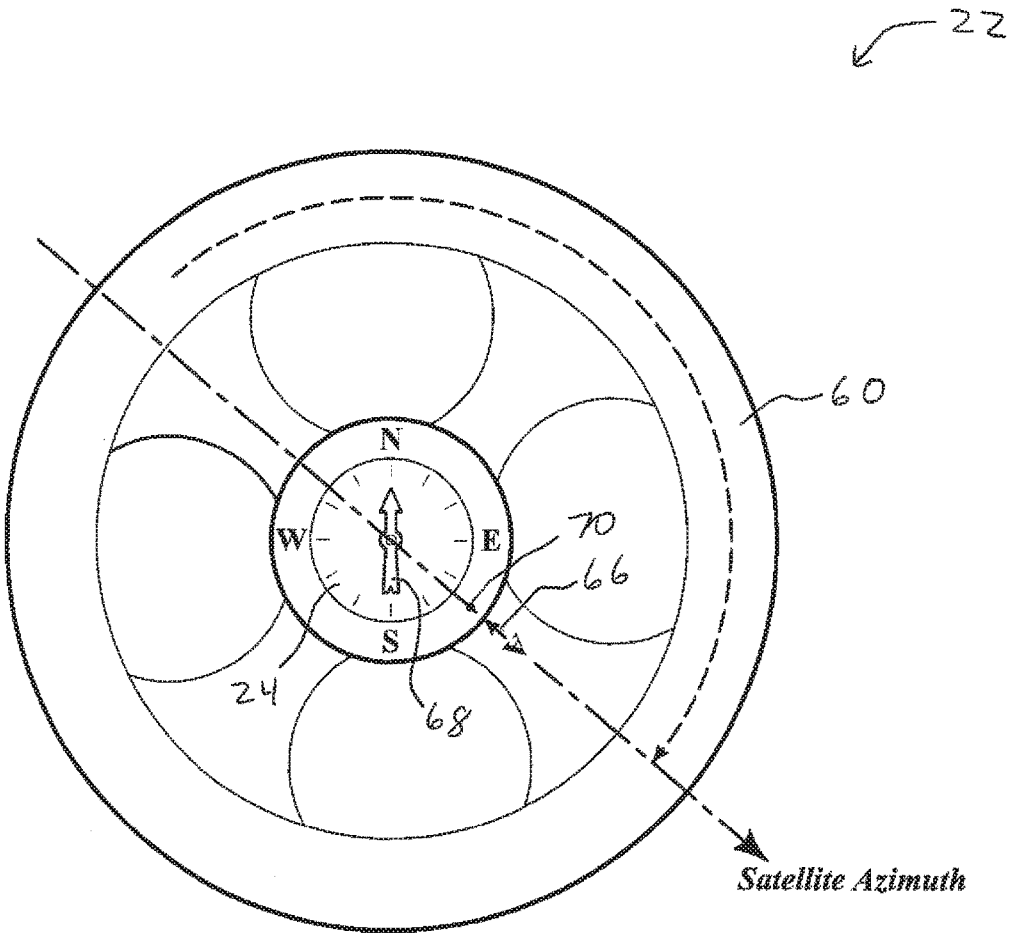

FIGS. 2A-2C are simplified views of a base and compass of an antenna orientation assembly according to one embodiment as described herein.

FIG. 2A illustrates a base 22 of the base assembly 16 shown above in FIGS. 1A-1C. The base 22 includes an outer portion 60 and an inner portion 62. A compass 24 is positioned on the inner portion 62, such as in a substantially central portion of the base 22. The inner portion 62 also includes an azimuth designation marker 66. The azimuth designation marker 66 indicated the azimuth of the antenna, when the base 22 is rotated about a rotational axis of a pointer 68 of the compass 24. The azimuth designation marker 66 is also aligned with the elevation axis of the antenna 18 to indicate pointing direction of the antenna towards the satellite(s) for signal peaking. The pointer 68 is configured to align with magnetic north.

As discussed above, a user is provided a desired azimuth for the antenna to receive signals from a satellite, which is illustrated by angle marker 70 on the compass 24. The user rotates the compass 24 until the angle marker 70 is aligned with the azimuth designation marker 66, which is illustrated in FIG. 2B. In some embodiments, only an outer rim of the compass 24 is rotated about the rotational axis of the pointer 68. Once the angle marker 70 is aligned with the desired azimuth marker 68, the user rotates the base 22 until the pointer 68 is aligned with north on the compass 24. In some embodiments, the compass may include additional functionality to adjust the declination between magnetic north and true north based on the current location of the antenna orientation assembly on the earth. In other embodiments, the desired azimuth provided to the user already includes the declination adjustment so that the user only has to rotate the base 22 and align the pointer 68 with north and make no other calculations or adjustments to the azimuth.

It should be recognized that the user can adjust the elevation of the antenna first such as discussed herein, followed by adjusting the azimuth. Or the user can first adjust the azimuth, followed by the elevation.

Figure 3A:
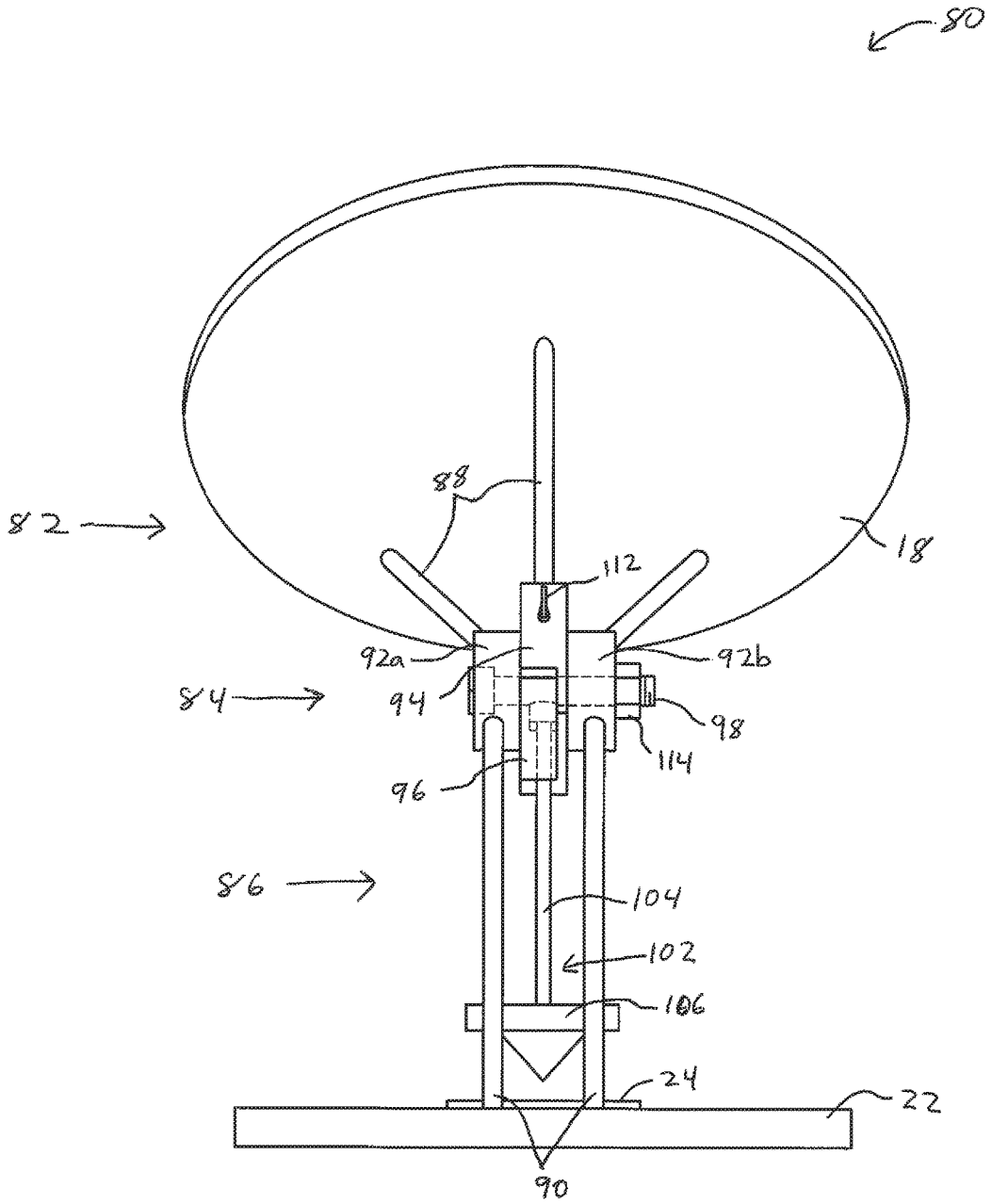
FIGS. 3A-3D are simplified views of an antenna orientation assembly according to another embodiment as described herein.
Figure 3B:
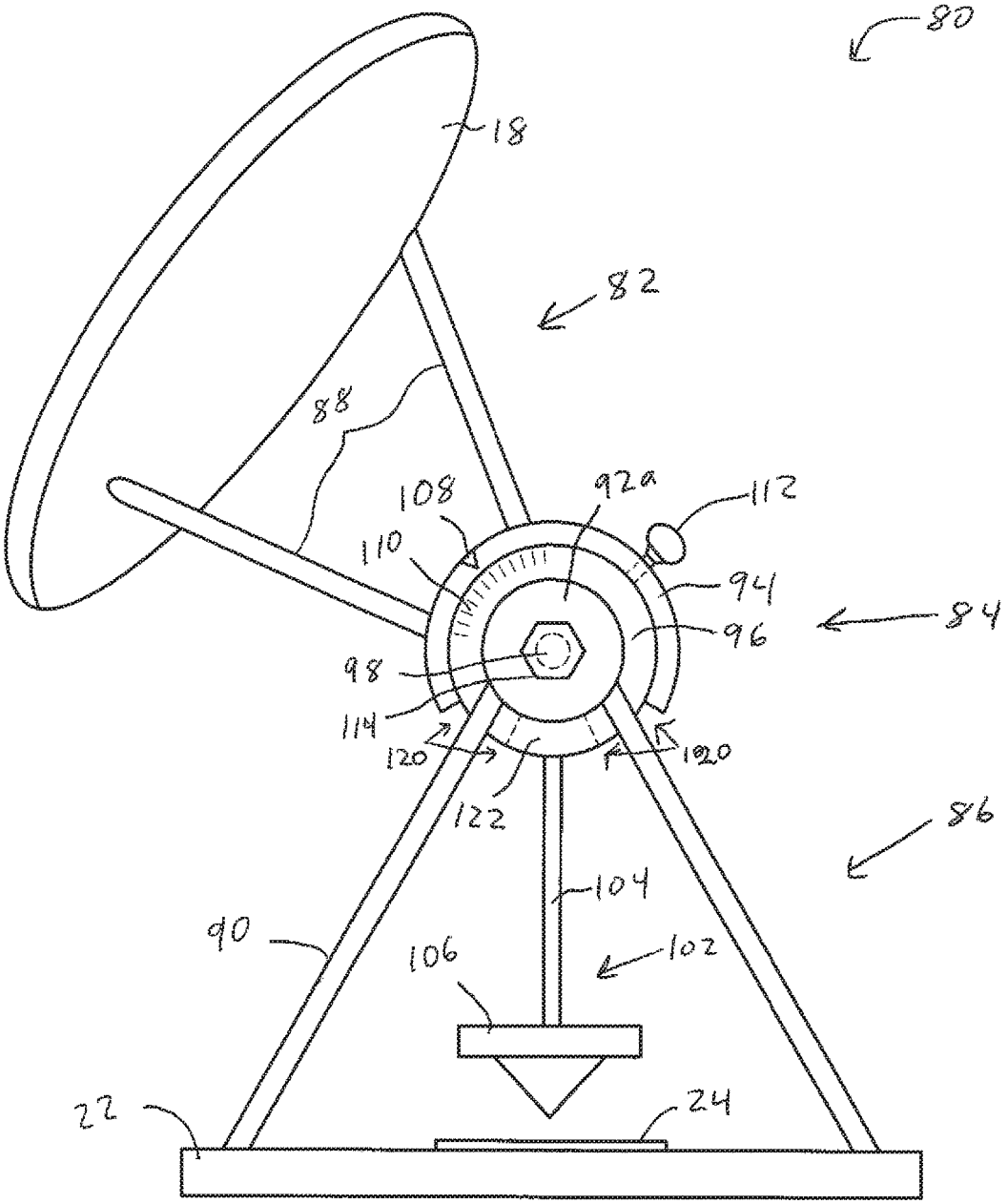
Figure 3C:
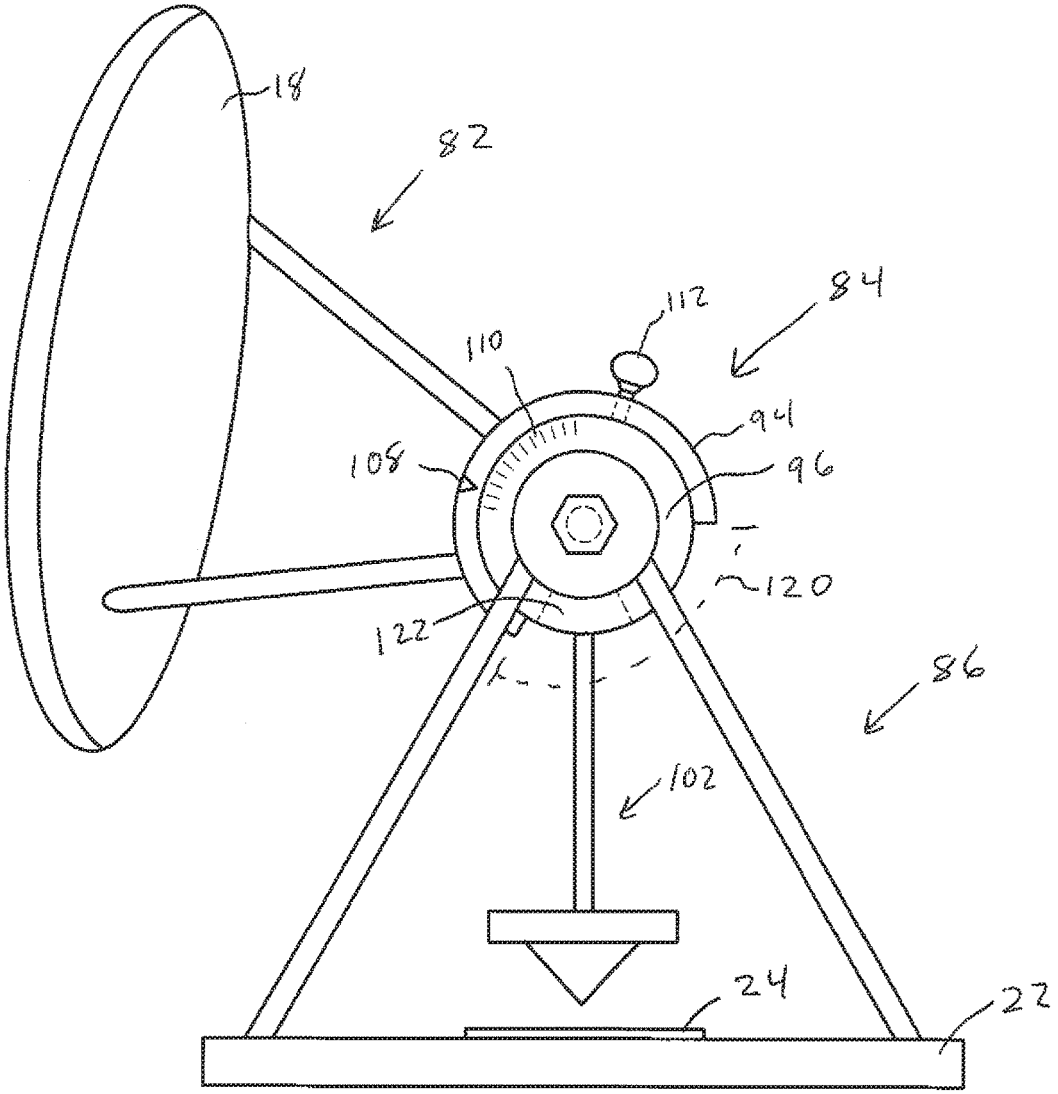
Figure 3D:
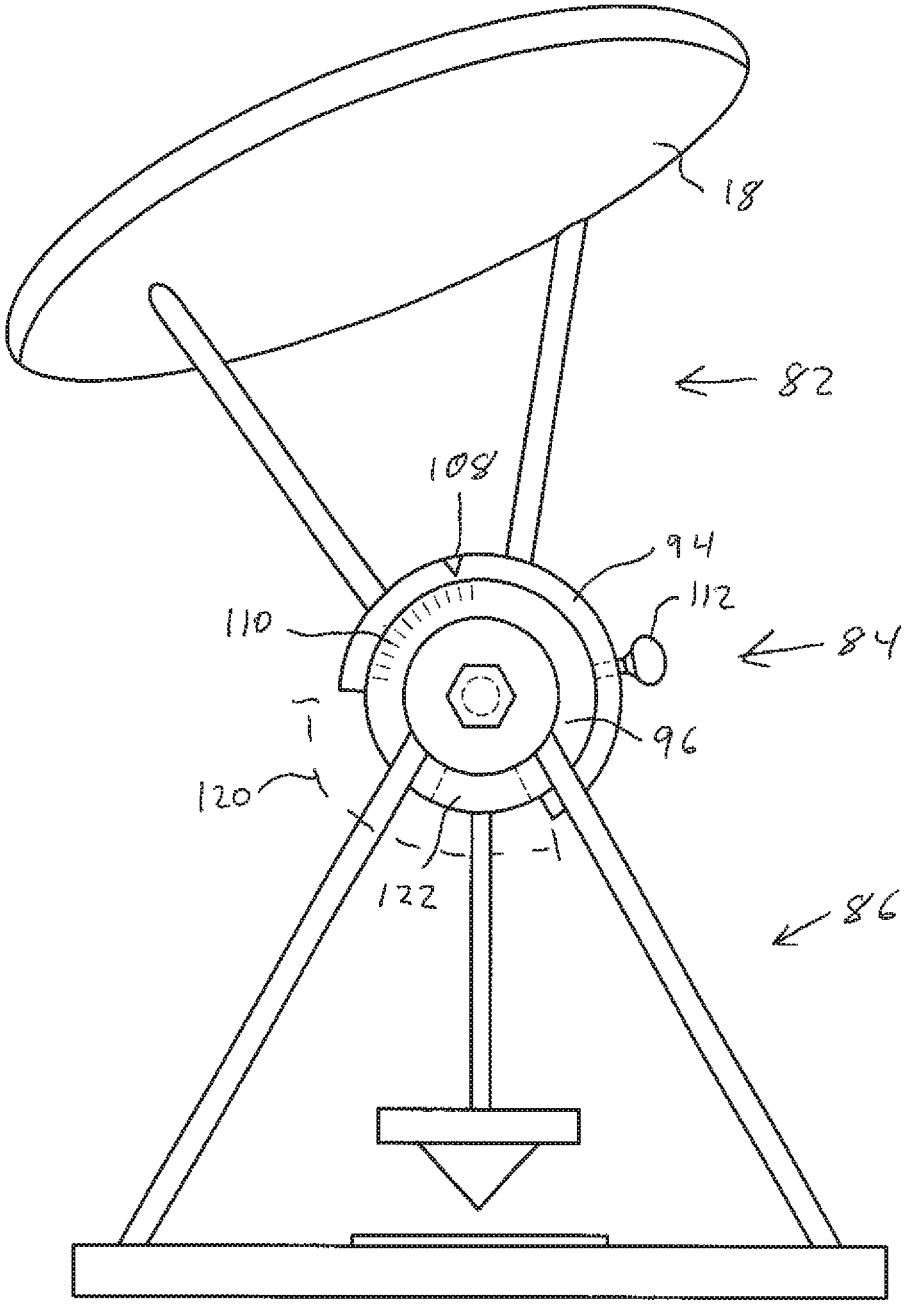
Figure 4A:
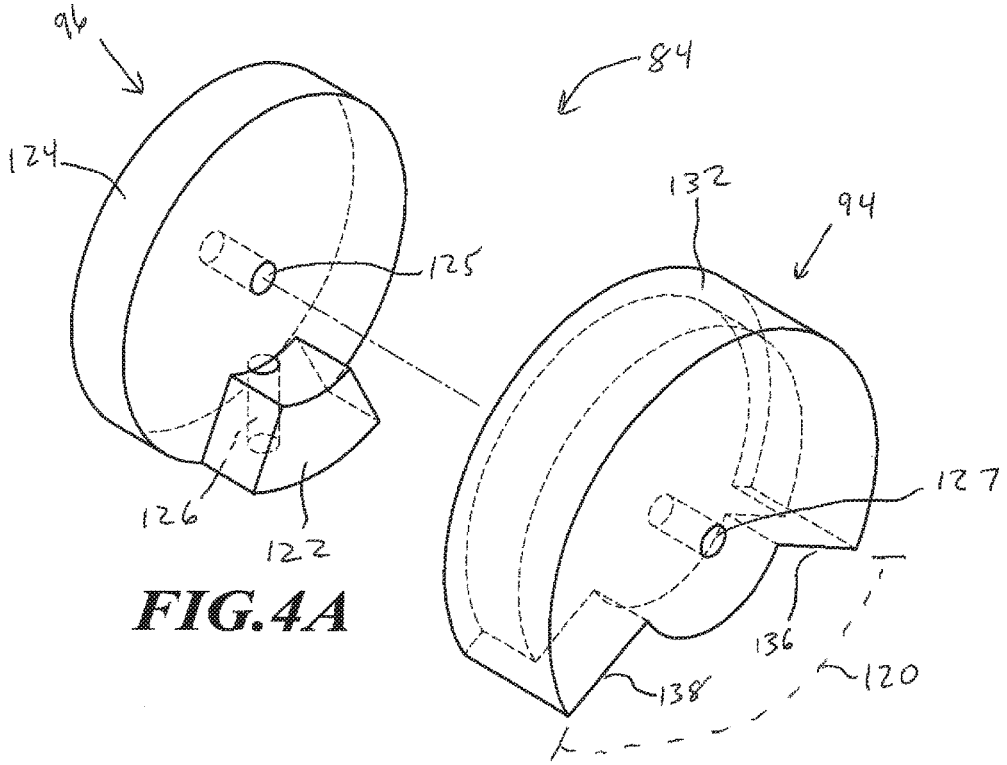
FIGS. 4A-4F are simplified views of an elevation alignment joint of the orientation assembly illustrated in FIGS. 3A-3D according to one embodiment as described herein.
Figure 4B:
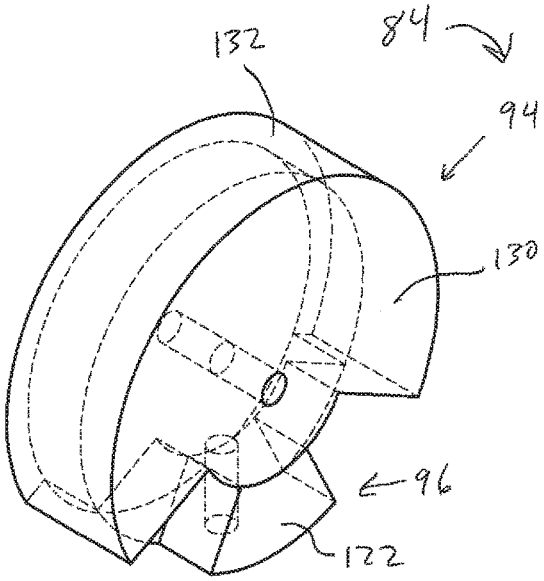
Figure 4C:
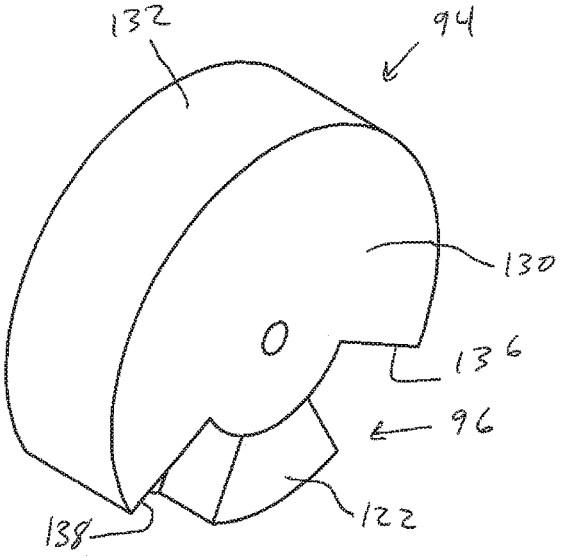
Figure 4D:
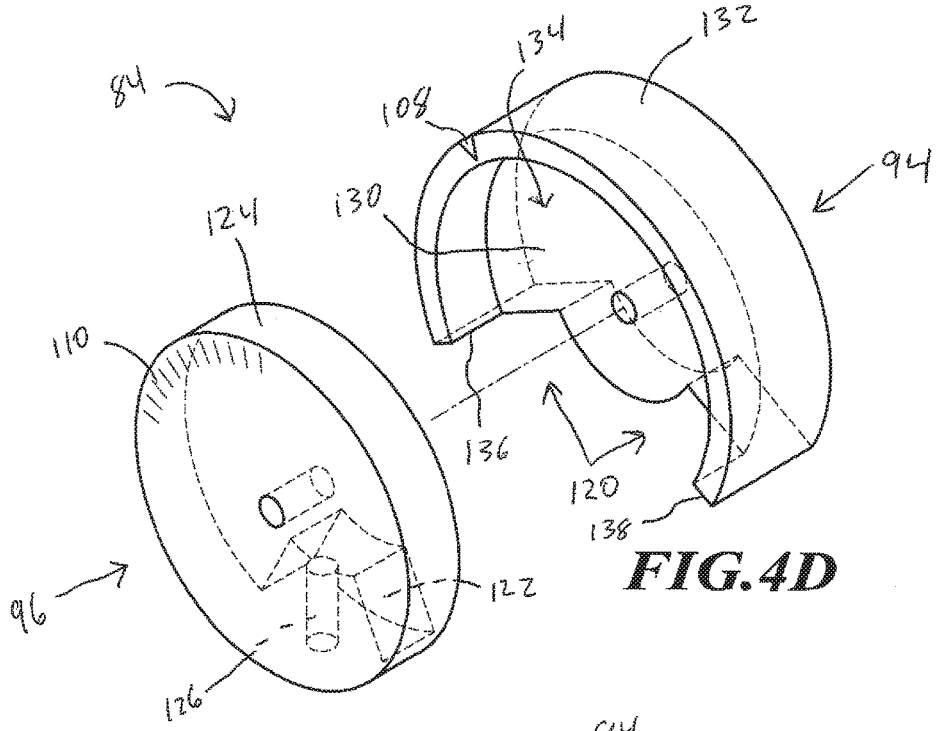
Figure 4E:
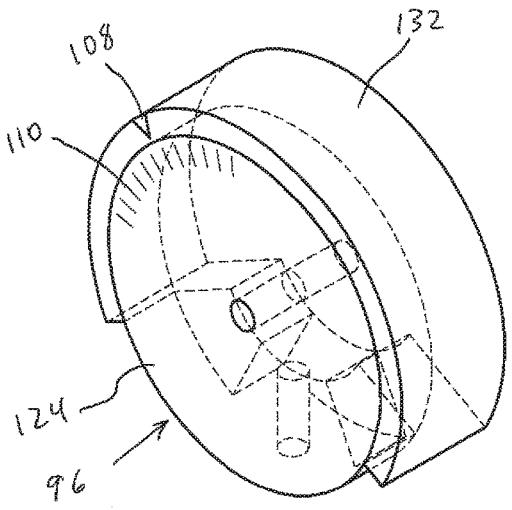
Figure 4F:
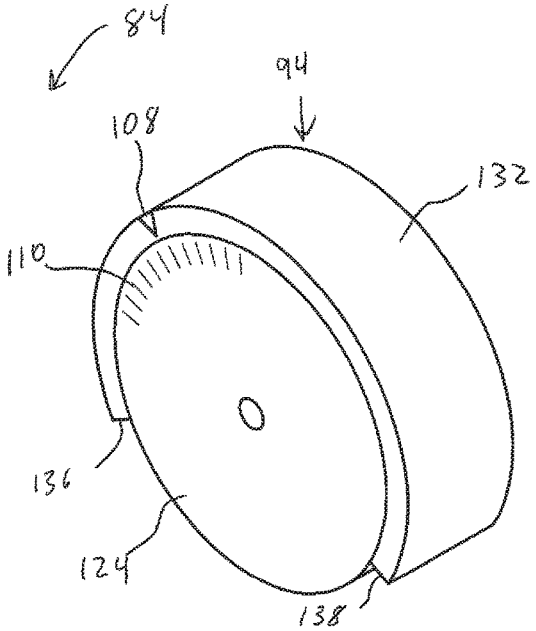
Figure 5A:
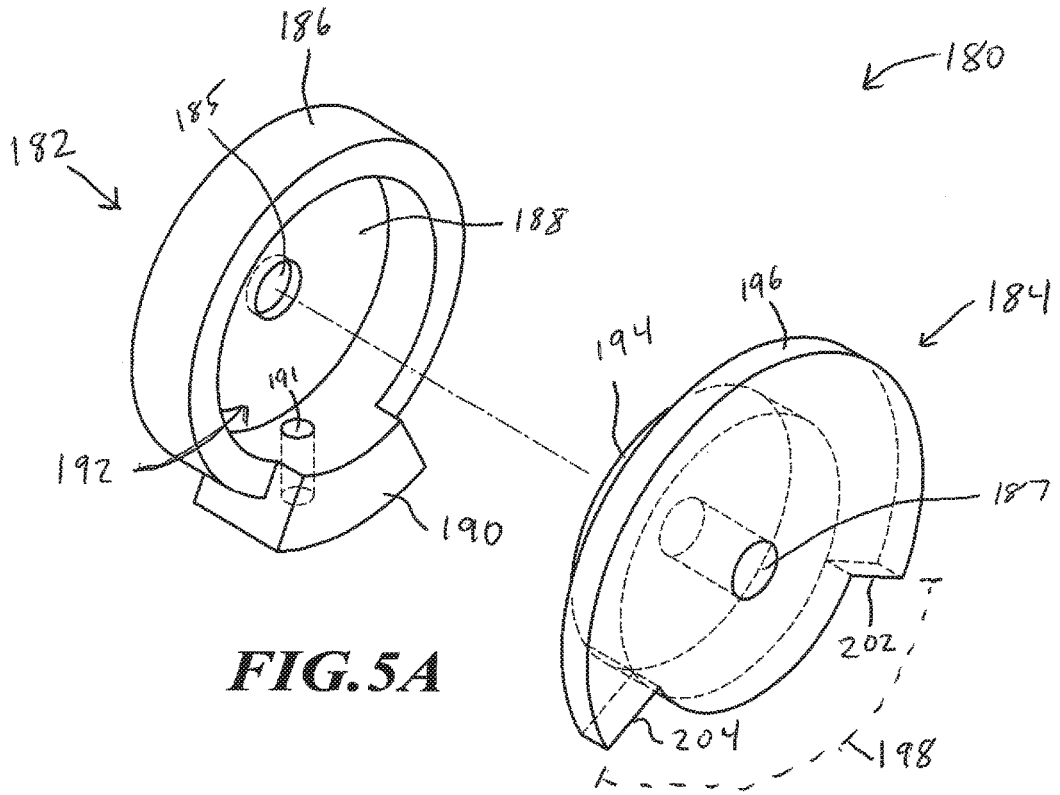
FIGS. 5A-5F are simplified views of an alternative elevation alignment joint according to one embodiment as described herein.
Figure 5B:
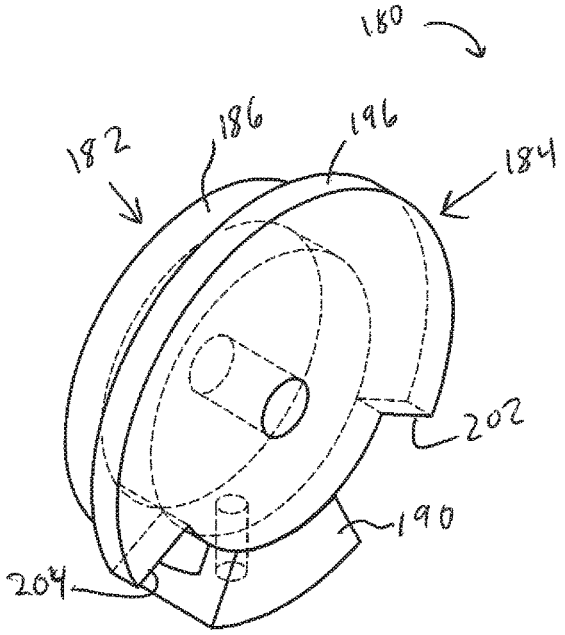
Figure 5C:
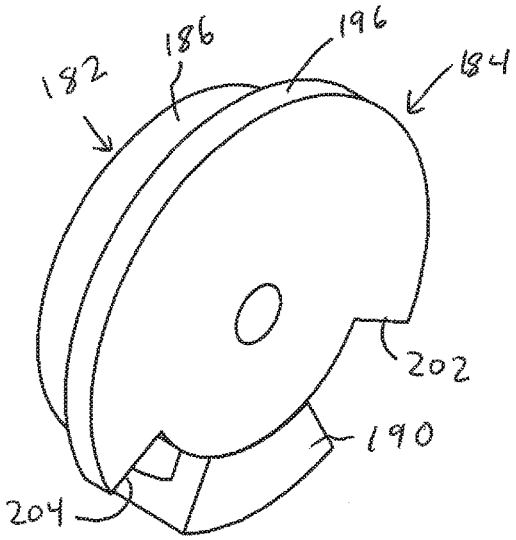
Figure 5D:
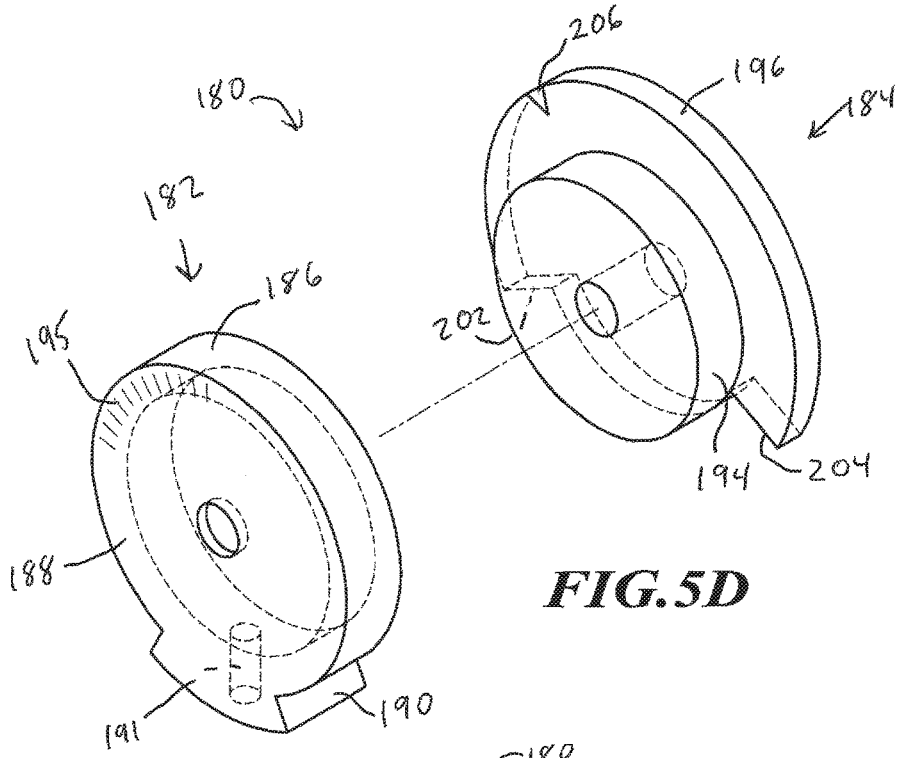
Figure 5E:
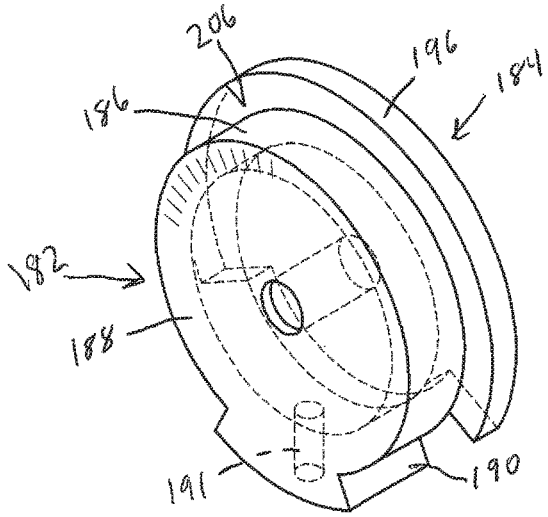
Figure 5F:
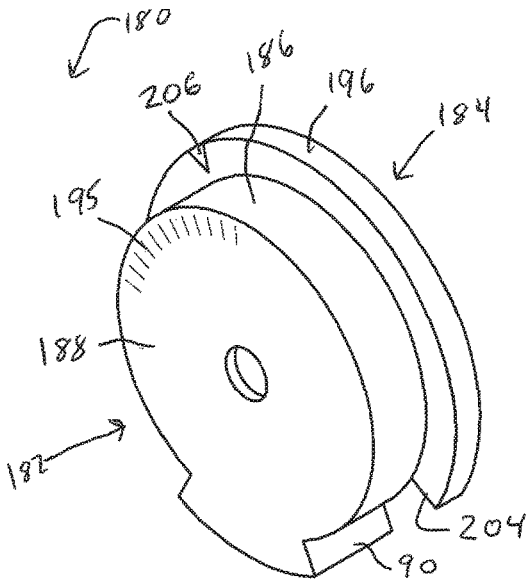

FIGS. 3A-3D are simplified views of an antenna orientation assembly according to another embodiment as described herein. FIG. 3A is a simplified back view of an antenna orientation assembly 80. FIG. 3B is a simplified side view of the antenna orientation assembly 80. And FIGS. 3C and 3D are simplified side views of the antenna orientation assembly 80 with an antenna 18 positioned at different elevations.

The antenna orientation assembly 80 includes an antenna assembly 82, an elevation alignment joint 84, and a base assembly 86.

The antenna assembly 82 includes an antenna 18 and a plurality of antenna support members 88. The antenna support members 88 are configured to connect the antenna 18 to the rest of the antenna orientation assembly 80, where a first end of the antenna support members 88 is configured to connect to the antenna 18 and a second end is configured to connect to the elevation alignment joint 84.

The base assembly 86 includes a base 22, a compass 24, and base support members 90. The base 22 and the compass 24 are embodiments of the base and compass described above, such that the compass 24 and the base 22 are configured to position the antenna 18 at a desired azimuth to peak the received signal from a satellite, which is discussed in more detail above in conjunction with FIGS. 2A-2C. Similar to what is illustrated in FIG. 1A, the compass 24 is positioned near a central location on the base 22. Although, embodiments are not so limited and the compass 24 may be positioned at other locations on the base 22 or the base assembly 86.

The base support members 90 of the base assembly 86 are configured to connect the elevation alignment joint 84 to the base 22, where a first end of the base support members 90 is configured to connect to the base 22 and a second end is configured to connect to the elevation alignment joint 84. In various embodiments, the base support members 90 are configured to position the elevation alignment joint 84 substantially centered and over the compass 24, such as is illustrated.

The elevation alignment joint 84 includes base connection members 28*a*-28*b*, an antenna connection member 94, and a plumb connection member 96 that are aligned on axle 98 along a central axis. The elevation alignment joint 84 is configured to attach the antenna assembly 82 to the base assembly 86 while allowing for adjustment of the elevation of the antenna 18.

The base connection members 92*a*-92*b* of the elevation alignment joint 84 are configured to connect the elevation alignment joint 84 to the base support members 90 of the base assembly 86. The antenna connection member 94 of the elevation alignment joint 84 is configured to connect the antenna support members 88 of the antenna assembly 82 to the elevation alignment joint 84.

The plumb connection member 96 of the elevation alignment joint 84 is configured to be connected to a plumb 102. The plumb 102, when connected to the plumb connection member 96, is configured to allow gravity to position the plumb 102 in a vertical or plumb position. The plumb 102 includes a plumb mast 104 and a plumb weight 106. One end of the plumb mast 104 connects to the plumb connection member 96 and the other end of the plumb mast 104 connects to the plumb weight 106. The weight of the plumb weight 106 is selected such that the total weight of the plumb 102 is more than the weight of the antenna assembly 82 plus any additional weight from cables or other components attached to the antenna assembly 82, which allows the plumb 102 to self-align in a vertical position when fixed to the antenna assembly 82.

The antenna connection member 94 and the plumb connection member 96 are configured to freely rotate along the axle 98 relative to the base connection members 92*a*-92*b*. In this way, the angle or elevation between the antenna 18 and the plumb mast 104 can be adjusted. The elevation alignment joint 84 is discussed in more detail below in conjunction with FIGS. 4A-4F, but briefly, in some embodiments, the antenna connection member 94 of the elevation alignment joint 84 is disk-like with a mouth perpendicular to the central axis and the plumb connection member 96 of the elevation alignment joint 84 is disk-like with an elevation range guide (also referred to as stopping portion of the plumb connection member 96) sized to fit inside the mouth of the antenna connection member 94 and to allow the antenna connection member 94 to move relative to the plumb connection member 96 between a minimum and maximum antenna elevation. In some embodiments, the antenna connection member 94 is ring-shaped with a mouth and the plumb connection member 96 is disk-shaped and sized to fit inside the antenna connection member 94 with the plumb mast 104 of the plumb 102 passing through the mouth of the antenna connection member 94.

The antenna connection member 94 includes an antenna elevation marker 108. The antenna elevation marker 108 indicates the elevational direction of the antenna 18. Conversely, the plumb connection member 96 includes a plurality of elevation markers 110. The elevation markers 110 indicate different elevations relative to the plumb mast 104.

Since the elevation alignment joint 84 and the plumb connection member 96 are configured to allow the plumb 102 to self-align the plumb mast 104 in a vertical position, the elevation markers 110 indicate the possible elevation positions of the antenna 18. Moreover, since the elevation alignment joint 84 and the antenna connection member 94 are configured to allow the antenna connection member 94 freely rotate about the axle 98, the elevation of the antenna 18 can be adjusted with respect to the plumb 102 by aligning the antenna elevation marker 108 on the antenna connection member 94 with the desired elevation on the elevation markers 110 on the plumb connection member 96. As mentioned above, the user is provided the desired elevation based on the geographical location of the antenna orientation assembly 80 and the position of the satellite that is transmitting the orbital signals to the antenna 18.

Once the antenna assembly 82 is positioned such that the antenna elevation maker 108 on the antenna connection member 94 of the elevation alignment joint 84 is aligned with the desired elevation on the elevation markers 110 on the plumb connection member 96, a first locking mechanism 112 is engaged. Engagement of the first locking mechanism 112 fixes the position of the antenna connection member 94 with the plumb connection member 96. In this way, the elevation angle of the antenna 18 is secured relative to the plumb 102.

In the illustrated example, the first locking mechanism 112 is a set screw through the antenna connection member 94, and when engaged exerts pressure on the plumb connection member 96 to secure the position of the antenna connection member 94 and the plumb connection member 96 relative to one another. It should be recognized that other types of locking mechanisms between the antenna connection member 94 and the plumb connection member 96 may also be employed. For example, the plumb mast 104 may act as a set screw that passes through the plumb connection member 96 to exert pressure on the antenna connection member 94 when engaged.

With the first locking mechanism 112 engaged, and the second locking mechanism 114 disengaged, the plumb 102 is allowed to self-align in a vertical position, which aligns the antenna 18 into the desired elevation. Once the plumb 102 is self-aligned in a vertical position, the second locking mechanism 114 is engaged to fix the position of the antenna connection member 94 and the plumb connection member 96 relative to the base connection members 92*a*-92*b*.

In the illustrated example, the second locking mechanism 114 is a nut that screws onto the axle 98, which secures the antenna connection member 94 and the plumb connection member 96 between the base connection members 92*a*-92*b*. It should be recognized that other types of locking mechanisms between the base connection members 92*a*-92*b* and the locked antenna connection member 94 and the plumb connection member 96 may also be employed. For example, a set screw (not illustrated) through the base connection member 92*a* may be utilized, and when engaged exerts pressure on the plumb connection member 96 to secure the position of the locked antenna connection member 94 and plumb connection member 96 relative to the base connection members 92*a*-92*b*. As another example, a set screw (not illustrated) through the base connection member 92*b* may be utilized, and when engaged exerts pressure on the antenna connection member 94 to secure the position of the locked antenna connection member 94 and plumb connection member 96 relative to the base connection members 92*a*-92*b*.

FIG. 3C illustrates the antenna orientation assembly 80 with the antenna 18 positioned at a minimum elevation, and FIG. 3D illustrates the antenna orientation assembly 80 with the antenna 18 positioned at a maximum elevation. As shown in more detail below in conjunction with FIGS. 4A-4F, the antenna connection member 94 includes a mouth portion or opening 120 to allow a stopping portion 122 of the plumb connection member 96 move between a minimum antenna elevation position (FIG. 3C) and a maximum antenna elevation position (FIG. 3D). The opening 120 is sized larger than the diameter of the plumb mast 104 to limit the angle between the plumb weight 102 and the antenna 18 between the minimum and maximum elevation.

FIGS. 4A-4F are simplified views of an elevation alignment joint of the orientation assembly illustrated in FIGS. 3A-3D according to one embodiment as described herein. The elevation alignment joint 84 includes the plumb connection member 96 and the antenna connection member 94, as discussed above—however, the base connection members are not shown in FIGS. 4A-4F for each of illustration. Similarly, the plumb and antenna support members described above are not shown as being connected to the plumb connection member 96 and the antenna connection member 94, respectively, for ease of illustration.

The antenna connection member 94 includes an inner disk 130 and an outer ring 132. The inner disk 130 includes a central axial bore 127 about which the antenna connection member 94 can rotate on the axle 98 in FIG. 3A. The outer ring 132 extends away from the inner disk 130 along the central axis to form a cavity 134. The outer ring 132 includes the antenna elevation marker 108 in the same direction in which the outer ring 132 extends away from the inner disk 130, which is to illustrate the elevation of the antenna relative to the plumb attached to the plumb connection member 96. The outer ring 132 is not a complete ring, but instead includes opening 120 having a first edge 136 and a second edge 138.

The plumb connection member 96 includes a disk 124 and a stopping portion 122. The disk 124 includes a central axial bore 125 about which the plumb connection member 96 can rotate on the axle 98 in FIG. 3A. The disk 124 is configured to fit into the cavity 134 of the antenna connection member 94 with the central axial bore 125 of the disk 124 aligning with the central axial bore 127 of the antenna connection member 94.

The stopping portion 122 extends away from the disk 124 in the same direction as the central axis of the disk 124. The stopping portion 122 is position on the disk 124 such that, when the disk 124 of the plumb connection member 96 is positioned in the cavity 134 of the antenna connection member 94, the stopping portion 122 is positioned in the opening 120 of the outer ring 132 of the antenna connection member 94. In this way, the antenna connection member 94 can rotate about the central axis of the plumb connection member 96. As the antenna connection member 94 rotates relative to the plumb connection member 96, the first edge 136 of the opening 120 on the outer ring 132 of the antenna connection member 94 abuts the stopping portion 122 on the plumb connection member 96 at a minimum elevation for the antenna. Conversely, as the antenna connection member 94 is rotated in the opposite direction relative to the plumb connection member 96, the second edge 138 of the opening 120 on the outer ring 132 of the antenna connection member 94 abuts the stopping portion 122 on the plumb connection member 96 at a maximum elevation for the antenna.

The plumb connection member 96 also includes an aperture or connection point 126 for a plumb (not illustrated) to connect to the plumb connection member 96, as described herein. In some embodiments, the connection point 126 is centered perpendicular to the central axis of the disk 124 between the disk 124 and the stopping portion 122 (as illustrated), or fully in the stopping portion 122 (not illustrated). This allows, in some embodiments, for the plumb to act as a locking mechanism against the antenna connection member 94, as discussed above. The disk 124 includes a plurality of elevation markers 110 on a size opposite of the extension of the stopping portion 122.

FIGS. 5A-5F are simplified views of an alternative elevation alignment joint 180 according to one embodiment as described herein. The elevation alignment joint 180 includes a plumb connection member 182 and an antenna connection member 184. In various embodiments, the elevation alignment joint 180 may be utilized in the antenna orientation assembly 10 in FIGS. 3A-3D—however, the base connection members are not shown in FIGS. 5A-5F for each of illustration. Similarly, the plumb and antenna support members described above are not shown as being connected to the plumb connection member 182 and the antenna connection member 184, respectively, for ease of illustration.

The plumb connection member 182 includes an outer ring 186, an inner disk 188, and an elevation stopper 190. The inner disk 188 includes a central axial bore 185 about which the plumb connection member 182 can rotate on the axle 98 in FIG. 3A. The inner disk 188 also includes an aperture or connection point 191 for a plumb (not illustrated) to connect to the plumb connection member 182, as described herein. The outer ring 186 extends away from the inner disk 188 along a central axis to form a cavity 192. The elevation stopper 190 extends away from the outer ring 186 in the same direction as the central axis of the outer ring 186. The inner disk 188 includes a plurality of elevation markers 195 on a size opposite of the extension of the outer ring 186 away from the inner disk 188.

The antenna connection member 184 includes an inner disk 194 and an elevation adjustment member 196. The inner disk 194 along with the elevation adjustment member 196 includes a central axial bore 187 about which the antenna connection member 184 can rotate on the axle 98 in FIG. 3A. The inner disk 194 is configured to fit into the cavity 192 of the plumb connection member 182 with a central axis of the inner disk 194 aligning with the central axis of the outer ring 186 of the plumb connection member 182. The elevation adjustment member 196 is a disk-like shape that includes an opening 198 having a first edge 202 and a second edge 204. The elevation adjustment member 196 also includes an antenna elevation marker 206 on a same side as the inner disk 194 to illustrate the elevation of the antenna relative to the plumb attached to the plumb connection member 182

When the inner disk 194 of the antenna connection member 184 is positioned in the cavity 192 of the plumb connection member 182 with the stopper 190 of the plumb connection member 182 positioned in the opening 198 of the elevation adjustment member 196, the antenna connection member 184 can rotate about the central axis of the plumb connection member 182. As the antenna connection member 184 rotates relative to the plumb connection member 184, the first edge 202 of the opening 198 on the elevation adjustment member 196 abuts the elevation stopper 190 on the plumb connection member 184 at a minimum elevation for the antenna. Conversely, as the antenna connection member 184 is rotated in the opposite direction relative to the plumb connection member 184, the second edge 204 of the opening 198 on the elevation adjustment member 196 abuts the elevation stopper 190 on the plumb connection member 184 at a maximum elevation for the antenna.

In some embodiments, weights or anchors (not illustrated) may be utilized by the user to secure the antenna orientation assembly to the ground or other structure on which the antenna orientation assembly 10 is positioned. Additionally, in some situations the user may need to tune the peaking position of the antenna. In such a situation, the user can slightly loosen either of the locking mechanisms to slightly alter the elevation of the antenna, as needed, to achieve a higher peaking signal strength. Similarly, the user can slightly rotate the base of the antenna orientation assembly to alter slightly the azimuth of the antenna.

The antenna orientation assemblies described herein result in a mobile mounting apparatus that enables a user to set an antenna at a peaking elevation and azimuth for the antenna to receive signals from a satellite. The antenna orientation assemblies provide low cost solutions for easy installation of an antenna by a user.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A system, comprising:

an antenna having at least one mounting support;

a plumb having a mast and a weight connected to a first end of the mast;

an elevation alignment joint having a first member connected to a second end of the mast and a second member connected to the at least one mounting support, the first and second members being configured to rotate about a central axis with the first member indicating an elevation of the antenna when the plumb is in a vertical position; and a base assembly having a base, a compass positioned on the base to indicate an azimuth of the antenna, and at least one base support having a first end connected to the base and a second end configured to hold the elevation alignment joint in the plumb in the vertical position.

2. The system of claim 1, further comprising:

a locking mechanism configured to maintain the elevation of the antenna by fixing a position of the second member of the elevation alignment joint relative to the first member of the elevation alignment joint.

3. The system of claim 1, further comprising:

a locking mechanism configured to maintain the elevation of the antenna by fixing a position of the elevation alignment joint with the plumb in the vertical position.

4. The system of claim 1, wherein the compass is positioned in a substantially central position of the base with the second end of the at least one base support positioned to hold the elevation alignment joint with the plumb in the vertical position over the compass.

5. The system of claim 1, wherein the second member of the elevation alignment joint is disk-like with a mouth perpendicular to the central axis and the first member of the elevation alignment joint is disk-like with an elevation range guide sized to fit inside the mouth of the second member and to allow the second member to move relative to the first member between a minimum and maximum antenna elevation.

6. The system of claim 1, wherein the second member of the elevation alignment joint is ring-shaped with a mouth and the first member of the elevation alignment joint is disk-shaped and sized to fit inside the second member with the mast of the plumb passing through the mouth of the second member.

7. The system of claim 1, wherein the plumb is sized to weigh more than the antenna and the at least one mounting support.

8. An antenna orientation assembly, comprising:

a plumb weight;

an elevation hinge having a first portion that is connected to the plumb weight and a second portion second portion configured to mount an antenna, the first portion and the second portion being flexibly connected to adjust an angle between the plumb weight and the antenna; and a base assembly having a footing, a compass positioned to indicate an azimuth of the antenna orientation assembly, and at least one support leg having a first end connected to the footing and a second end configured to hold the elevation hinge with the plumb weight in a vertical position.

9. The antenna orientation assembly of claim 8, further comprising:

a locking mechanism configured to secure the angle between the antenna the plumb weight.

10. The antenna orientation assembly of claim 8, further comprising:

a locking mechanism configured to secure the elevation hinge with the plumb in the vertical position.

11. The antenna orientation assembly of claim 8, wherein the compass is positioned in a substantially central position of the footing with the second end of the at least one support leg positioned to hold the elevation hinge with the plumb weight in the vertical position over the compass.

12. The antenna orientation assembly of claim 8, wherein the first and second portions of the elevation hinge are parallel disk-like structures that spin on a central axis, the second portion having an angle adjustment aperture and the first portion having angle adjustment member configured to fit inside the angle adjustment aperture and create a minimum and maximum for the angle between the plumb weight and the antenna.

13. The antenna orientation assembly of claim 8, wherein the second portion of the elevation hinge is ring-shaped having an aperture and the first portion of the elevation hinge is disk-shaped and sized to fit inside the second portion with the plumb weight passing through the aperture of the second portion, wherein the aperture is sized larger than a diameter of the plumb weight that passes through the aperture to limit the angle between the plumb weight and the antenna.

14. The antenna orientation assembly of claim 8, wherein the plumb weight is sized to weigh more than the antenna and at least one mounting support that connects the antenna to the elevation hinge.

15. An antenna base assembly, comprising:

an antenna elevation hinge having an axle from a first member through a second member and a third member, the first and second members being configured to rotate about the axle to adjust an elevation of an antenna;

a plumb having a mast and a weight, the weight being connected to a first end of the mast and a second end of the mast being connected to the first member of the antenna elevation hinge and configured to orient the mast in a vertical position;

at least one antenna mounting support having a first end connected to the second member of the antenna elevation hinge and a second end configured to be connected to the antenna; and a stand assembly having a base, a compass positioned to indicate an azimuth of the antenna, and at least one support leg having a first end connected to the base and a second end connected to the third member of the antenna elevation hinge configured to hold the antenna elevation hinge with the plumb hanging in the vertical position and the antenna at the elevation.

16. The antenna base assembly of claim 15, further comprising:

a locking mechanism configured to set an angle between the antenna and the plumb by securing the first member of the antenna elevation hinge to the second member of the antenna elevation hinge.

17. The antenna base assembly of claim 16, wherein the plumb weight is sized to maintain the antenna at the elevation when the first and second members are locked together.

18. The antenna base assembly of claim 15, further comprising:

a locking mechanism configured to set the elevation antenna by securing the first and second members of the antenna elevation hinge to the third member of the antenna elevation hinge.

19. The antenna base assembly of claim 15, wherein the antenna elevation hinge includes a fourth member positioned opposite of the third member with the first and second members positioned there between, and wherein the stand assembly further includes at least one additional support leg having a first end connected to the base and a second end connected to the fourth member of the antenna elevation hinge.

20. The antenna base assembly of claim 15, wherein the at least one support leg of the stand assembly is structured to hold the antenna elevation hinge with the plumb in a vertical position over the compass.

* * * * *